US006082432A

United States Patent [19]

Kissinger

[11] Patent Number: 6,082,432

[45] Date of Patent: Jul. 4, 2000

[54] SCREEN DOOR ACCESSORY

[76] Inventor: Daren Kissinger, 787 Masons Beach Rd., Deale, Md. 20781

[21] Appl. No.: 09/119,615

[22] Filed: Jul. 22, 1998

[51] Int. Cl.[7] ..... A47G 5/02

[52] U.S. Cl. ..... 160/290.1; 160/27; 160/28; 160/273.1

[58] Field of Search ..... 160/23.1, 26, 27, 160/28, 98, 99, 100, 112, 110, 133, 270, 102, 272, 274, 266, 267.1, 282, 284, 285, 287, 289, 245, 299, 313, 323.1, DIG. 10, 273.1, 259

[56] References Cited

U.S. PATENT DOCUMENTS

| | | | |
|---|---|---|---|
| 729,630 | 6/1903 | Milans | 160/289 |
| 1,063,830 | 6/1913 | Rader | 160/285 |
| 1,871,141 | 8/1932 | Baker et al. | 160/273.1 X |
| 1,971,451 | 8/1934 | Helfmann | 160/28 |
| 2,107,755 | 2/1938 | Kemp | 160/28 |
| 2,615,513 | 10/1952 | Radford | 160/28 |
| 3,489,200 | 1/1970 | Recchione | 160/41 |
| 3,911,990 | 10/1975 | Hoover et al. | 160/28 X |
| 4,359,081 | 11/1982 | Brower | 160/28 X |
| 4,467,853 | 8/1984 | Downey, Jr. | 160/41 X |
| 4,649,981 | 3/1987 | Bibeau | 160/273.1 X |
| 4,819,295 | 4/1989 | Kaftan | 16/72 |
| 4,993,468 | 2/1991 | Hackman et al. | 160/27 |
| 4,999,948 | 3/1991 | Hodgens | 49/74 |
| 5,392,835 | 2/1995 | Wildt | 160/269 |
| 5,794,678 | 8/1998 | Beringer et al. | 160/273.1 X |

*Primary Examiner*—Daniel P. Stodola
*Assistant Examiner*—Bruce A. Lev
*Attorney, Agent, or Firm*—Laurence R. Brown

[57] ABSTRACT

A roll-up screen door appliance for drawing a screen panel horizontally across the span of a door frame, which advantageously may be stably positioned in a partly open position for permitting persons to pass through with a minimum opening, thereby reducing the opening size for entry of insects. The screen panel is rolled up on a spring-biassed, vertically-oriented supply roller and is withdrawn by a manually moved pull rod clamped to the distal end of the screen panel. The pull rod is frictionally held in a stable position across the span of the accompanying door frame as it is withdrawn and the friction is overcome manually as the screen is retracted upon the storage roller by a spring biassed mechanism. A hollow rubber tubing, resting on both sides of a U-shaped channel across the span of the door provides a frictional clamp against end structure upon the pull rod which resides in both top and bottom channel members as it travels across the span of the door and tautly stretches the screen panel in position adjacent the corresponding door framework. The screen is protected against intrusion of insects by means of opposing brushes contacting upper and lower screen panel edges across the width of the door span as the screen panel is withdrawn from the roller. A light weight rectangular framework, enclosing a vertically oriented supply roller at one side, can be made of interconnected aluminum structural members to be fastened to a door frame about single or double pivoted mounted doors or sliding door pairs.

12 Claims, 2 Drawing Sheets

SCREEN DOOR ACCESSORY

TECHNICAL FIELD

This invention relates to door screens, and more particularly it relates to horizontally movable door screens rolled upon and unrolled from a vertically oriented roller storage site adjacent a door frame member.

BACKGROUND ART

It has heretofore been proposed to roll upon and unroll door screens from a vertically disposed roller mechanism. Typical of such prior art are U.S. Pat. No. 4,651,797, Mar. 24, 1987 to A. E. Lange for ROLL-UP SCREEN DOOR; U.S. Pat. No. 5,758,704, Jun. 2, 1998 to C. K. Elrod for ROLL-UP SCREEN DOOR APPARATUS; and U.S. Pat. No. 5,505,244, Apr. 9, 1996 to P. A. Thumann for RETRACTABLE COVERING FOR A DOOR OPENING.

One significant deficiency of these screens is that the screen can only be in two stable states, namely fully retracted and stored upon the roll and fully extended and latched between two opposed door frames. Thus, for example, the door screen, which is spring biased to return to the roller could not be partly opened across the door opening between vertical door frames, for example, for the purpose of letting a person walk either in or out of a partly open sliding door alongside the screen. Alternatively for use with a pivoted door, the necessary fully open screen required by the prior art would permit insects, flies, etc. entry across the entire screen door width in order to let a person walk in or out of the door. This prior art is thus suited only generally for the purpose of retaining the screen fully closed or fully open while the doors are either closed or fully or partly opened.

Also the complexity of the structure and the tediousness of extending a rolled up screen across a door opening and latching it in place with these prior art mechanisms is not only costly, but is inconvenient and awkward.

There has been no satisfactory treatment in the prior art of screening French double doors having two sliding door panels so that the screen may be optionally viewed or hidden through the full length door glass, and so that the screen may be just partly opened for persons to pass through such a sliding door when partly opened.

Furthermore, known prior art mechanisms make it substantially impossible to secure the door opening against the entry of insects. In this respect there is insufficient protection against the entry of insects at the top and bottom of the screens, for example, if the screen were to flap or create gaps in the presence of a breeze or when touched by a person when opened.

Accordingly it is an objective of this invention to provide an improved simplified low cost, easy to install, screen accessory advantageous for use both with single doors and pivoted or sliding double doors configured to correct the foregoing prior art problems.

A more specific object of the invention is to employ screens more effectively to keep out insects as accompanying doors are opened and when the screens are fully withdrawn across the span of the door.

Another specific object of the invention is to provide a screen opening mechanism which permits the screen to reside stably in a partly open position.

Other objects, features and advantages of the invention will be found throughout the following description, drawings and claims.

DISCLOSURE OF THE INVENTION

The screen is essentially a rectangular fabric screen panel of a texture and stiffness that can be rolled up in response to a retraction spring onto a screen storage roller and unwound therefrom to extend as a planar sheet screen tautly disposed across a door opening. The top and bottom edges to be horizontally extended across the door opening are typically dressed or treated to eliminate wire ends and burrs thereby forming smoothly sliding panel edges. Thus these edges are disposed to ride in top and bottom channel tracks secured to the door framework for retaining and guiding the respective top and bottom screen edges across a door opening between vertical doorpost frames upon which the screen door accessory of this invention is mounted.

Accordingly, a horizontally movable vertically disposed pulling post preferably having a grasping handle, is clamped upon or otherwise secured to the outer end of the rolled up screen panel, typically by frictional clamping between rubber guide layers. This pulling post has panel-like ribs on opposite ends for riding in top and bottom horizontally oriented tracks defined by generally U-shaped channel members. In these channels, a frictional member such as hollow rubber tubing is disposed inwardly on opposite channel sides to frictionally grasp the pulling post ends and thus hold the screen in stable partly open position at any optional stopping site across the retaining rectangular framework. Thus the unrolled portion of the screen panel is held in place frictionally thereby overcoming the retraction spring bias of the screen storage roller, whether positioned to partly or fully close the door opening.

A stabilizing mechanism provided by squared panels at both ends of the pulling post is supplied with internally disposed spring loaded rollers to ride upon the respective top and bottom surfaces of the retaining channels. Thus, the pulling post rides smoothly across the door opening in response to manual actuation in a vertical posture as the screen is opened and closed. A spring mechanism in the screen storage roller assembly serves to retract the screen as the pulling post is manually returned to the roller site.

To stabilize the screen wire panel, reducing the tendency to gap when manually touched or flap in the presence of a breeze, there is provided an insect seal at the top and bottom screen edges, typically a brush extending inwardly from opposite channel walls into contact with the upper and lower edges of the screen panel which extend into the U-shaped channel tracks.

Thus, the screen accessory provided by this invention achieves the foregoing objectives of resolving deficiencies of the prior art to provide a different mode of operation, better insect control and minimal complexity and construction cost.

Other features and advantages will be found throughout the following description.

BRIEF DESCRIPTION OF THE DRAWINGS

In the accompanying drawings, wherein like reference characters in different views symbolize similar features.

THE PREFERRED EMBODIMENTS

Figure 1:
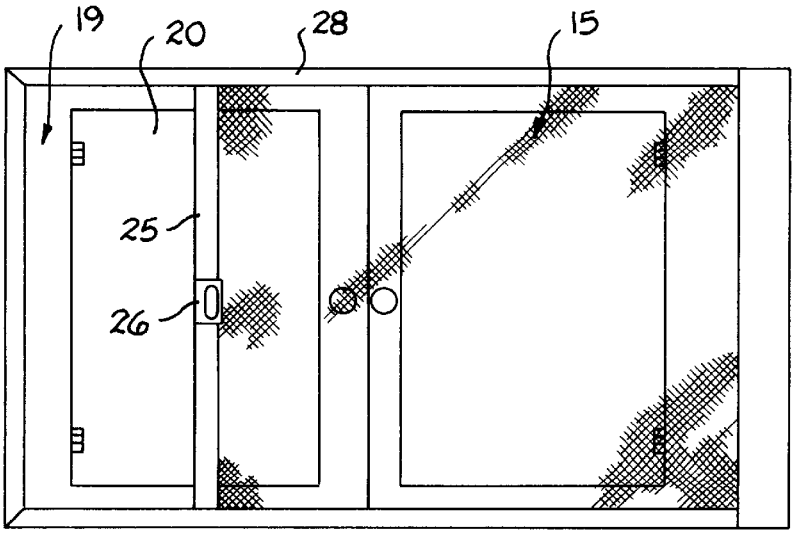
FIG. 1 is a front view of an installed screen appliance as afforded by this invention where the screen is resident in a partly open position in front of this door opening embodiment provided with a pair of pivotable doors.

Now with reference to the accompanying drawings, the roll up screen door appliance of this invention has a screen panel 15 rolled around a supply roller 16, which is spring biassed by the helically coiled spring 17, located within container ring 42 in roller housing cap 18, thereby to retract the screen panel 15 onto the supply roller 16. Conversely this structure permits the screen panel 15 to be manually withdrawn by movement of the pull rod 25 to a desired stable screening position when the screen panel pull rod 15 is positioned adjacent a door framework 19 surrounding one or more doors 20. These doors may be either the pivoted nature shown or French sliding doors. Note that a favorable feature of this invention is that the screen panel 15 may be stably lodged at any position across the span of the door such as the position shown in FIG. 1, thereby, for example, to restrict the size of the opening area and thus the entryway area for insects when persons wish to pass through the screen door.

Figure 5:
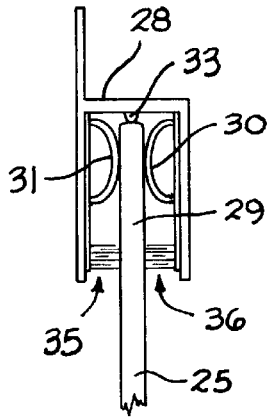
FIG. 5 is an end fragmental sketch looking into the upper horizontally disposed screen guiding channelwork of FIG. 2.
Figure 6:
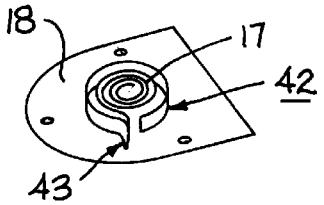
FIG. 6 is a lower fragmental view looking upwardly in FIG. 2 at a helical biassing spring carried by the roller housing cap.
Figure 7:
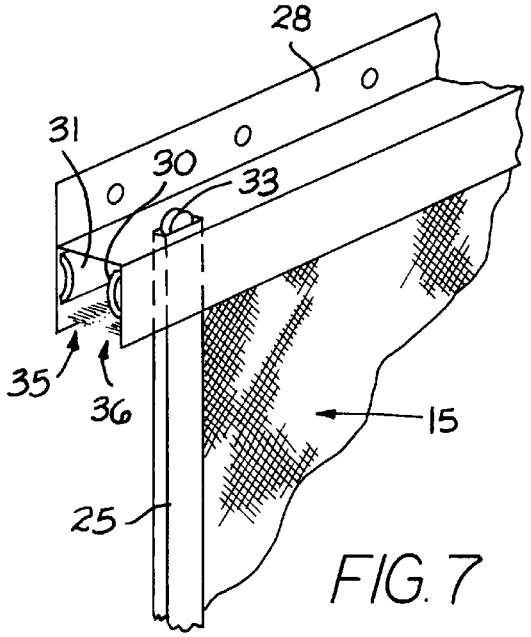
FIG. 7 is a fragmental sketch illustrating the interaction between the sliding screen pull rod and guidance channel for retaining the screen taut to keep out insects at bottom and top edges and for retaining the screen in partly open positions as shown in FIG. 1 by frictional contact of the pull rod with inner rubber retaining sash and brushes located in the guide channel framework on either side of the screen wire.

The mechanism for holding the screen panel stably at a plurality of chosen withdrawn positions with the screen extending part way across the span of the door is best visualized from FIGS. 5 and 7. Thus, a vertically disposable pull rod 25, having a manual actuation handle 26 is disposed at the distal end of the screen panel 15, where it is typically clamped onto the screen panel 15. The pull rod 25 is manually movable horizontally to withdraw the screen from the supply roller 16.

A framework for encompassing the screen panel 15 across the span of the door with the supply roller 16 disposed vertically at one horizontal end of the framework comprises at least one channeled horizontal track 28 for mating engagement with the pull rod 25 to guide the screen panel 15 across the span of the door opening as the screen panel 15 is withdrawn from the supply roller 16. For mating inside the channel of track 28, a substantially flat sided end panel member 29 is disposed at the upper tip of the pull rod 25 for entering the upper channel for being frictionally grasped between typically two hollow rubber frictional pad members 30, 31 thereby to retain the screen panel 15 tautly as aided by the tension from spring biassed roller 16. The frictional pads 30, 31 can be hollow rubber tubes for example with the inner air pressurized, if desired.

From the tip surface end of the pull rod 25 extends the preferably spring loaded roller 33, which rides on the upper inside flat surface of the U-shaped channel of track 28 to facilitate horizontal pull rod movement with the pull rod 25 vertically inclined. The generally rectangular flat tip configuration of the pull rod ends from which the roller 33 extends serves to maintain the pull rod vertically oriented without slanting or tilting.

The upper and lower edges of the screen panel 15 are dressed on both sides to present smooth, burrless edges to engage the opposed brushes 35, 36 extending inwardly from opposite sides of the track 28 sidewalls, FIGS. 5 and 7. This constitutes insect impeding structure, and is disposed along said horizontal track across the span of the door to keep insects from passing through or around the screen panel in the presence of breezes that otherwise would cause flutter and gapping, and to resist gapping caused by contact with the extended screen surfaces.

Figure 2:
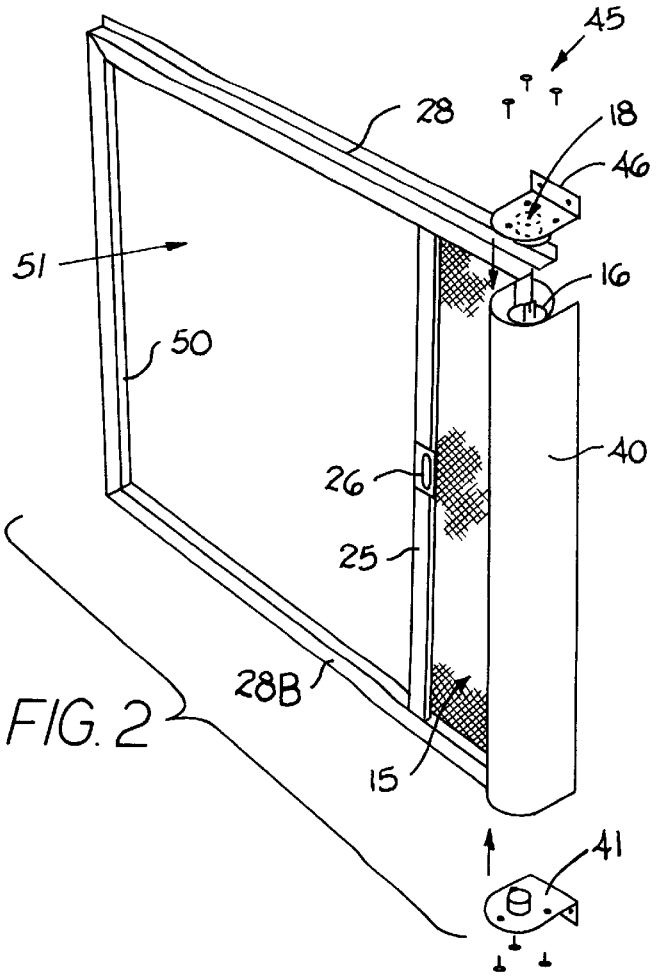
FIG. 2 is an exploded perspective view of the substantially rectangular screen framework showing the screen being unrolled from a vertical roller located at the right end.
Figure 4:
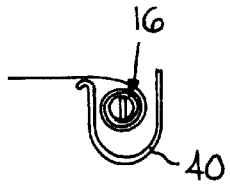
FIG. 4 is a top fragmental view of the screen storage roller and surrounding housing member, looking downwardly into the vertical roller of FIG. 2.

As seen from FIGS. 2 and 4, the accessory framework provides a substantially U-shaped cover 40 about the supply roller 16 with top and bottom removable caps 18, 41 for retaining the cover and fastening the cover to a door frame site. These caps 18, 41 are journalling members permitting the supply roller 16 to rotate during withdrawal and retraction of the screen panel 15.

One of the caps 18 comprises spring 17 as the roller's spring-biassing structure disposed within the cantainer ring 42. Thus, in effect there is affixed to cap member 18 the spring 17 with its outer end disposed upon tab 43 and the inner end ready for mating with supply roller 16. The inner end of the spring 17 and the upper end of the supply roller 16 thus have mutually mating fittings for engaging the supply roller to the spring, thereby serving to roll up the screen panel 15 upon the roller 16 and permitting retraction of the screen panel 15.

Note that the upper cap 18 is attached by screws 45 to L-bracket tabs within the U-shaped cover 40, and to a mounting wall by screws through the bracket flange 46. In order to vary tension on the screen panel 15, the helical spring 17 may be rotated in several settings by turning the cap 360 degrees before the cap 18 is attached to the roller 16 and cover 40.

Figure 3:
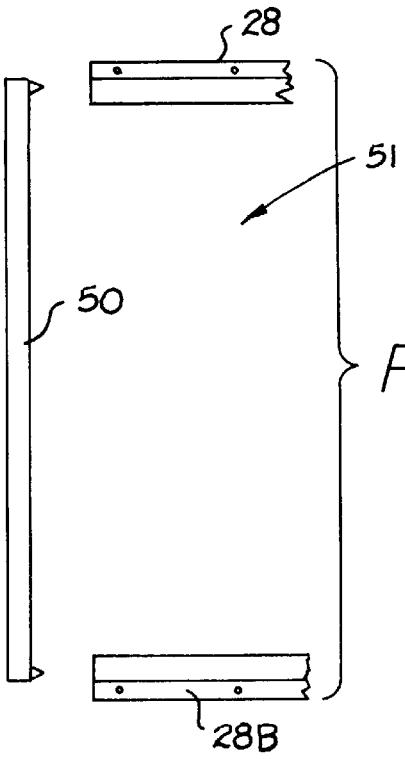
FIG. 3 is an exploded view of interconnections of framework members in a screen door accessory embodiment provided by this invention, looking into the left end of the screen framework as seen in FIG. 2.

As may be seen from FIG. 3, the rectangular framework is constructed of several structural members, preferably of light aluminum extrusions, which are connected in assembled form by appropriate welding or fasteners. Thus the top U-shaped track 28 and the bottom U-shaped track 28B are connected by the brace 50 at the end opposite to the screen supply roller 16 to define the opening 51 into which the screen 15 may be withdrawn.

From the foregoing disclosure, it is seen that this invention has improved the state of the art with novel structural and operational features. Those features of novelty illustrative of the nature and spirit of the invention are defined in particularity in the following claims.

I claim:

1. A door and rolled up screen system, comprising in combination, a generally rectangular door mounting framework, a mounted door which opens from a closed door position spanning the mounting framework and defining a plane in the closed door position a roll up screen door appliance having a screen panel biased to roll up on a roller, a housing positioning the roller alongside said framework for unrolling the screen panel alongside the framework in a parallel and spaced relationship to the plane of the door in the closed position, a positioning mechanism to selectively position the screen panel when unrolled from said roller in a screening position alongside said rectangular framework, and retaining means comprising friction members for overcoming roller spring bias to hold the screen panel in a manually selected stable position for extending in a partly open screening position alongside the mounting framework.

2. The improvement of claim 1 wherein said positioning mechanism further comprises: a vertically disposed pull rod affixed to the screen panel and corresponding track means permitting horizontal movement alongside said framework upon manual actuation of the pull rod to withdraw the screen from said supply roller with the supply roller disposed at one horizontal end of the framework, said track means comprising at least one horizontal track for mating with said pull rod to guide the screen panel across the framework as the screen panel is withdrawn from said supply roller and retracted.

3. The improvement of claim 2 further comprising frictional means operable between said pull rod and said horizontal track to retain the screen panel tautly in said selected partly open screening position.

4. The improvement of claim 3 wherein said frictional means comprises hollow resilient tubular members disposed along said horizontal track.

5. The improvement of claim 2 wherein said horizontal track comprises top and bottom framework members providing channelways dimensioned to receive upper and lower edges of the screen panel as it is withdrawn across the framework.

6. The improvement of claim 5 further comprising insect impeding means disposed along said horizontal track to keep insects from passing through the screen panel.

7. The improvement of claim 6, wherein said insect impeding means further comprises opposed brushes directed inwardly from walls of said channelways thereby to mate in contact with top and bottom edges of the screen panel.

8. The improvement of claim 2 wherein said framework further comprises a cover about said supply roller with top and bottom removable caps for retaining the cover, fastening the cover to a door frame site and journalling the supply roller for rotation to dispense and retract the screen panel.

9. The improvement of claim 8 wherein one of said caps comprises roller spring biassing means having affixed thereto a bias spring for retracting the screen panel in storage position about the supply roller, and mutually mating fittings for engaging the supply roller to the bias spring.

10. The improvement of claim 9 wherein the roller spring biassing means further comprises selectively adjustable means for adjusting spring biassing force exerted upon said supply roller.

11. The improvement of claim 2 wherein the track means comprises top and bottom horizontal tracks, wherein said pull rod has end structure further comprising rolling members for riding in contact with the horizontal tracks, and accompanying end structure stabilizing means for stabilizing the vertical position of the pull rod as it is moved horizontally across the span of the door.

12. The improvement of claim 2 wherein said framework comprises an assembly of interconnected light weight aluminum framework members.

* * * * *